United States Patent [19]

Aoki

[11] Patent Number: 4,527,332

[45] Date of Patent: Jul. 9, 1985

[54] HANDY SCISSORS

[76] Inventor: Takaaki Aoki, 8-D-329, 2-Chome, Nakatsu, Ohyodo-Ku, Osaka-Shi, Osaka-Fu, Japan

[21] Appl. No.: 554,499

[22] Filed: Nov. 23, 1983

[30] Foreign Application Priority Data

Nov. 30, 1982 [JP] Japan ..... 57-182005[U]
Jun. 23, 1983 [JP] Japan ..... 58-97715[U]

[51] Int. Cl.[3] ..... B26B 13/08; B26B 13/10
[52] U.S. Cl. ..... 30/234; 30/230
[58] Field of Search ..... 30/234, 235, 253, 229, 30/230

[56] References Cited

U.S. PATENT DOCUMENTS

| | | | |
|---|---|---|---|
| 914,613 | 3/1909 | Storlie | 30/234 |
| 1,125,577 | 1/1915 | Manypenny | 30/234 X |
| 1,467,806 | 9/1923 | Naujoks | 30/234 X |
| 1,574,420 | 2/1926 | Finder | 30/229 |
| 3,142,607 | 7/1964 | Scherer | 30/234 X |

*Primary Examiner*—Jimmy C. Peters

*Attorney, Agent, or Firm*—Armstrong, Nikaido, Marmelstein & Kubovcik

[57] ABSTRACT

This invention relates to a pair of handy scissors for readily cutting paper, cloth, thread, synthetic resin films and other sheet-like or linear materials in doing paper craftwork or needlework or opening packing bags. The scissors are constructed in the following manner: A parting line of predetermined length is cut in a springy metal sheet of uniform thickness to form cut edges in the form of cut surfaces each crossing the planar surface of the metal sheet at an acute angle, the cut edges as such serving as a pair of cutting edges for shearing an object, the half portions of the metal sheet bisected by the cutting of the parting line being bent in vertically opposite directions along a pair of bending lines on the planar surface so that they are normally in a horizontally V-shaped opened state and are in such a relation as to cross the parting line at an obtuse angle, while a pair of opposed operating levers are attached to the half portions for closing the half portions against the spring force of the metal sheet so as to shear an object by the mutual rubbing action of the cutting edges.

5 Claims, 15 Drawing Figures

HANDY SCISSORS

BACKGROUND OF THE INVENTION

In the principle of the lever, the so-called proximal-pivot type scissors in which the force point is located between the load and pivot points are generally known. As for the forms of such scissors belonging to the simplest or handiest class, one shown in FIGS. 13–15 may be said to be typical.

In this form of scissors, as will be later described, the bent proximal end portion of a spring steel member bent in elongated horizontally U-shape is used as a pivot point, while the opposed front end portions are used as a pair of vertically opposed cutting blades, which are maintained normally opened and which, in use, are closed by the user grasping the scissors by hand so as to shear an object by the rubbing action of the cutting edges.

In this form, however, the thickness of the spring steel member is not uniform as a whole and instead the bent proximal end portion serving as the pivot point is thinned and flattened in sheet form for the purpose of imparting springiness thereto and it is also necessary to likewise thin and flatten the opposed front end portions into sheet form at right angles to said proximal end portion. Further, the front end portions must be specially machined to provide sharp cutting edges. For this reason, the manufacture of the scissors is still complicated, making it impossible to expect the effect of mass-production to the greatest extent.

Further, since the springy steel member is simply bent to bring the cutting edges into opposed relation for rubbing action, the cutting edges tend to move laterally away from each other when an object is to be cut, so that the object often remains clamped in a clearance between the rubbing cutting edges. Such phenomenon becomes more noticeable as the cutting edges are dulled in years of use or when the thickness of an object to be cut changes. To prevent this, it is necessary for the user to manually impart frictional urging forces in a lateral direction from the opposite sides so as to force the cutting edges to rub each other. Thus, it is clear that the lightness of action is decreased.

Further, the front end portions of the spring steel member having the cutting edges which are adapted to rub each other are left exposed, a fact which, coupled with the fact that the cutting edges tend to move laterally away from each other, makes the scissors very dangerous to use.

SUMMARY OF THE INVENTION

The present invention is intended to provide a pair of handy scissors useful for solving these problems and is directed to the proximal-pivot type in terms of the principle of the lever wherein the force point is located between the load and pivot points.

Accordingly, a first object of the invention is to provide an arrangement using a springy metal sheet of uniform thickness, wherein cut edges formed by cutting a parting line in the metal sheet are, as such, utilized as a pair of cutting edges for shearing an object, thus making it possible to manufacture such scissors automatically and continuously on a mass-production basis by simply punching out metal sheets by press work without having to add the step of separately machining the cutting edges of setting separately prepared cutting edges.

A second object of the invention is to provide an arrangement wherein the metal sheet is bisected into half portions by said parting line and the half portions are bent in vertically opposite directions so that they are always in a V-shaped open state, along a pair of bending lines which are formed on the planar surface of the metal sheet in such a relation as to cross said parting line at an obtuse angle, whereby frictional urging forces are imparted to the cutting edges to cause them to strike each other when the half portions are operated to close, thus preventing the cutting edges from escaping from the object, so as to ensure that the object can be positively sheared, improving the scissors operation.

In this case, if the outer surfaces of operating levers attached to the half portions for receiving the user's fingers are inclined surfaces crossing the planar surface of the metal sheet at an acute angle and if an arrangement is used to maintain said inclined surfaces parallel to each other or if an arrangement is added which, in bringing the half portions into said opened state, convexly curves the half portions in opposed relation to each other, then this, coupled with the organic or synergistic action of said arrangement, more positively prevents the cutting edges from escaping from the object; thus, the aforesaid objects can be achieved more effectively.

A third object of the invention is to provide an arrangement wherein the pair of operating levers attached to the half portions are opposed to each other so that they mesh with each other when the cutting edges are closed, and each half portion is designed to have a substantially L-shaped cross-section with a wing portion extending from the attaching portion of the half portion to lie across the other half portion, whereby the scissors can be stably held without changing to an incorrect attitude which causes rotation of the object, while ensuring that the object is positively cut by the rubbing action of the cutting edges, while the action of the operating levers covering the rubbing portions of the cutting edges ensures that anyone can use the scissors lightly without any danger.

Other objects of the invention will become apparent from the concrete arrangement of the invention as well as from the detailed description of preferred embodiments of the invention.

DETAILED DESCRIPTION OF THE PREFERRED EMBODIMENTS

Figure 1:
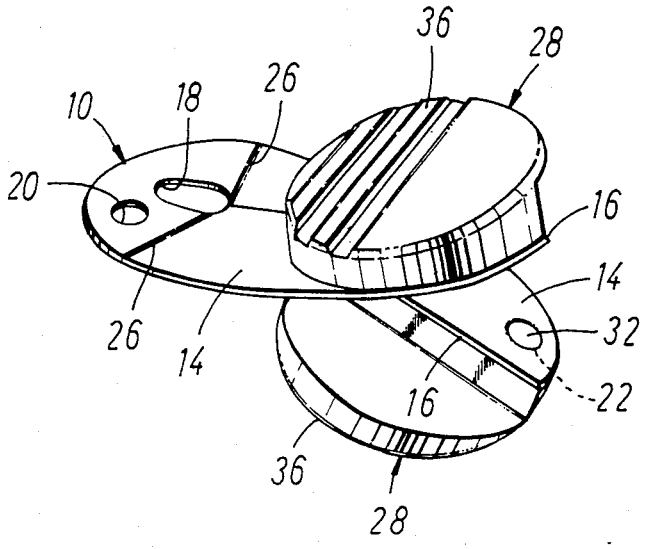
FIG. 1 is a perspective view of a pair of scissors according to the present invention.
Figure 2:
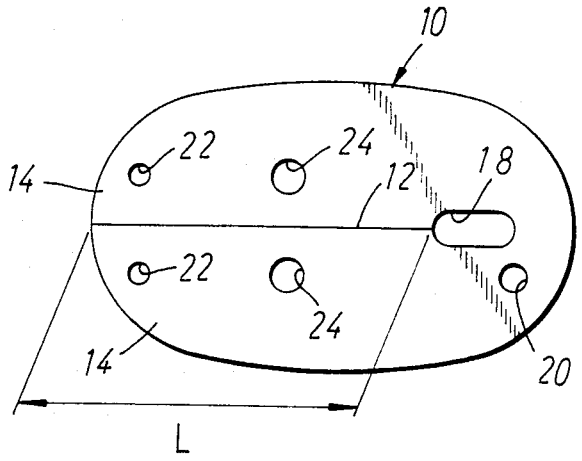
FIG. 2 is a plan view showing the punched out processed state of a metal sheet corresponding to the main portion of the scissors.

FIG. 1 shows a pair of handy scissors according to the present invention. The numeral 10 denotes a springy metal sheet of uniform thickness, which has been punched out in substantially oval form by press work, as shown in FIG. 2. However, the form is not limited to an oval and it may be a true circle or a quadrilateral with rounded corners. Preferably, the metal sheet 10 corresponding to the main body of the scissors is a relatively thin, e.g., about 0.3 to 0.8 mm thick, stainless steel sheet which has been quenched to have an increased strength and a suitable degree of springiness.

The numeral 12 denotes a parting line which is cut in the oval metal sheet 10 along the major axis thereof at the same time as the punching-out of the metal sheet 10 or by a separate subsequent process. The parting line, when viewed in a plan view shown in FIG. 2, is represented by a line segment of length L which partly leaves the continuity of the metal sheet 10 at its rear end. The rear end portion maintaining the continuity serves to provide a pivot point (corresponding to the pivot point of the scissors in the principle of the lever) for opening and closing half portions to be presently described.

As a result of the cutting of said parting line 12, the metal sheet 10 is bisected into half portions 14 whose out edges (which refer to the cut surfaces of the metal sheet) as such serve as the pair of cutting edges 16 of the scissors for shearing paper, thread, cloth, synthetic films and other sheet-like or linear object M; thus, there is no need to apply special machining to the cutting edges.

Figure 6:
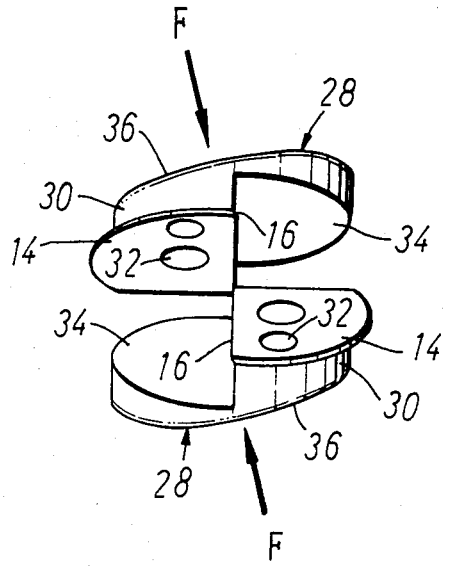
Figure 11:
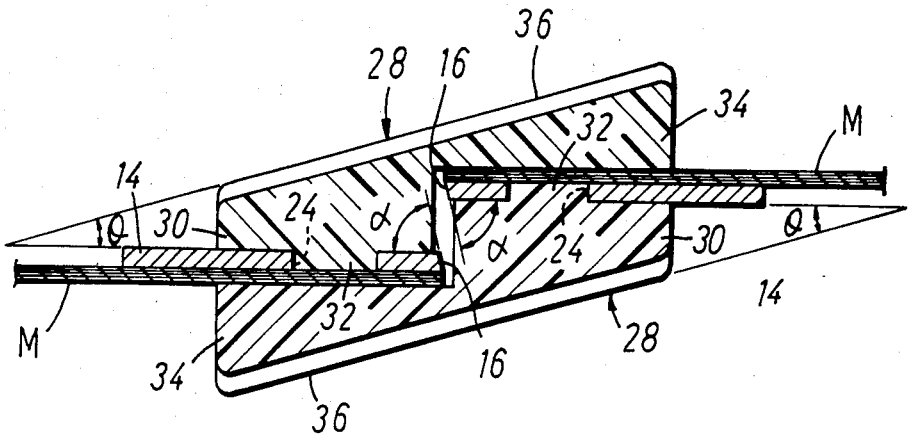
FIG. 11 is an enlarged sectional view taken along the line 11—11 of FIG. 8.
Figure 12:
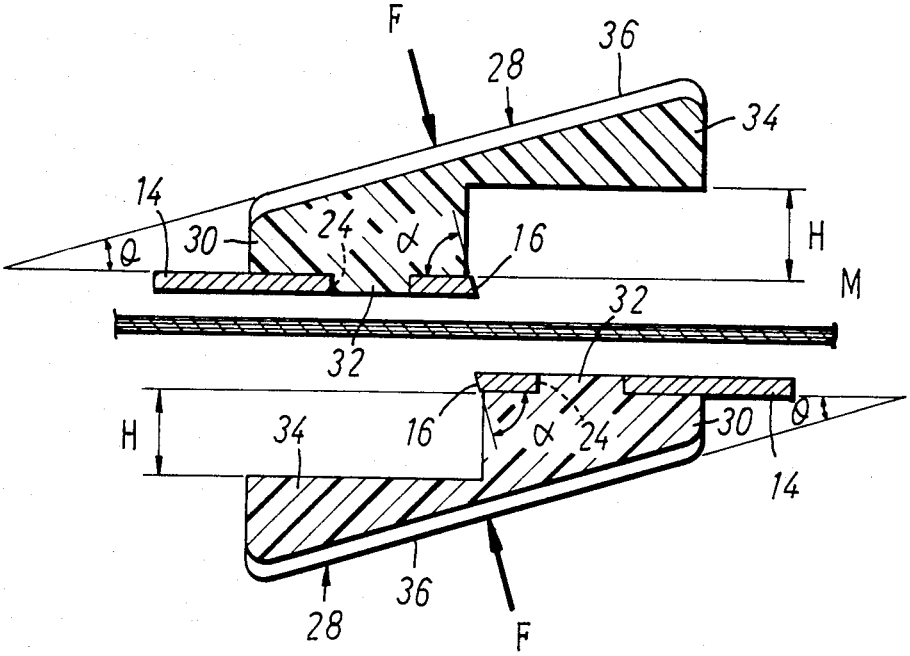
FIG. 12 is an enlarged sectional view showing the opened state of the scissors corresponding to FIG. 11.

Further, the cut edges resulting from the cutting of the parting line 12 are formed as the cut surfaces crossing the planar surface of the metal sheet at an acute angle $\alpha$, as is clear from FIGS. 6, 11 and 12. Thus, the edges with the acute angle $\alpha$ act to rub each other as the sharp cutting edges 16 capable of positively shearing said object M. Since the cutting edges 16 in the form of cut surfaces are simultaneously formed on the pair of half portions 14 by cutting the parting line 12 in the metal sheet 10, it is clear that the pair of cutting edges 16 are of symmetrical shape, opposed to each other.

Figure 3:
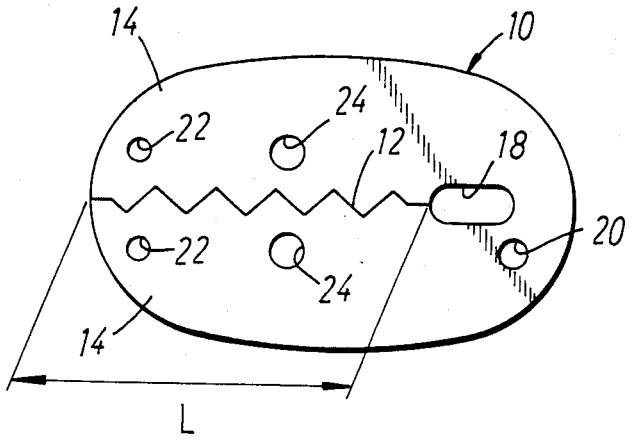
FIGS. 3 and 4 are plan views showing modifications corresponding to FIG. 2.
Figure 4:
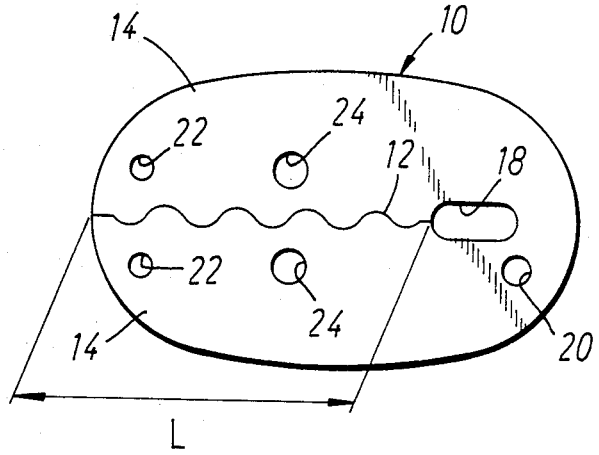

The parting line 12, when viewed in a plan view of the metal sheet 10 shown in FIG. 2, presents a linear form of length L. However, so long as the metal sheet 10 can be punched out by press work, the parting line may take a zigzag form comprising straight lines or curved lines, as shown in FIG. 3 or 4, or any other planar form so as to provide various special cut patterns of the object M. It goes without saying that such a special form of parting line 12 also provides a pair of cutting edges 16 formed of said opposed symmetrical cut surfaces having an acute angle $\alpha$.

Figure 8:
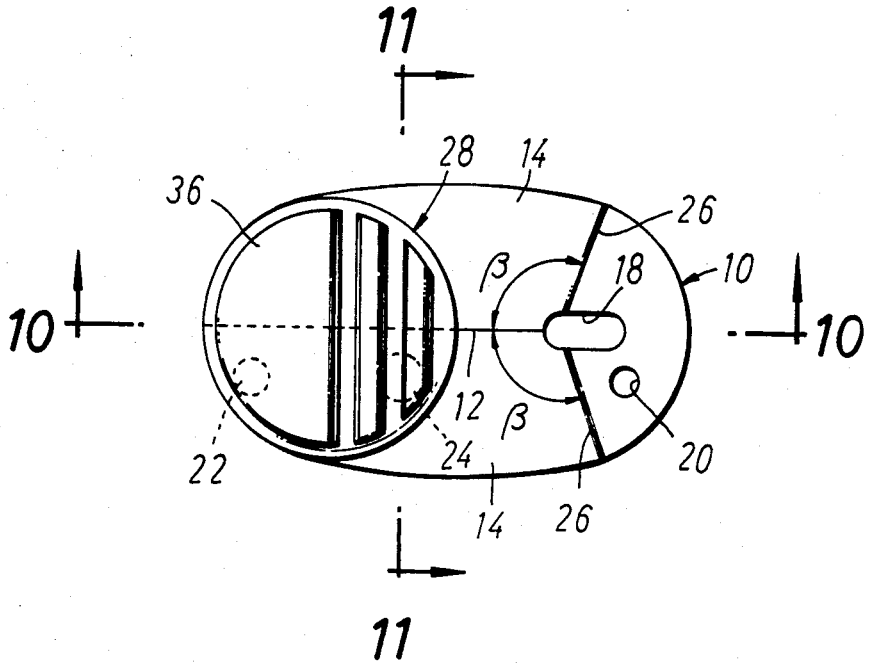

The numeral 18 denotes a halves-bending guide hole punched out simultaneously with the punching-out of the metal sheet 10, said hold being located in the portion of the metal sheet in which the parting line 12 forming said cutting edges 16 terminates. The guide hole is in the form of an elongated opening extending along the major axis of the aforesaid oval, as shown in FIGS. 2 and 8. The numeral 20 denotes a keyholder receiving hole also punched out in the rear end portion of the metal sheet 10; thus, an unillustrated keyholder may be attached thereto to provide convenience for the user to carry the scissors with him. The numerals 22 and 24 denote a plurality of operating lever attaching holes (two symmetrical holes each, in the illustration) also punched out in the front end portions of the half portions 14 of the metal sheet 10, in which holes a pair of operating levers to be later described will be fixedly fitted.

Figure 5:
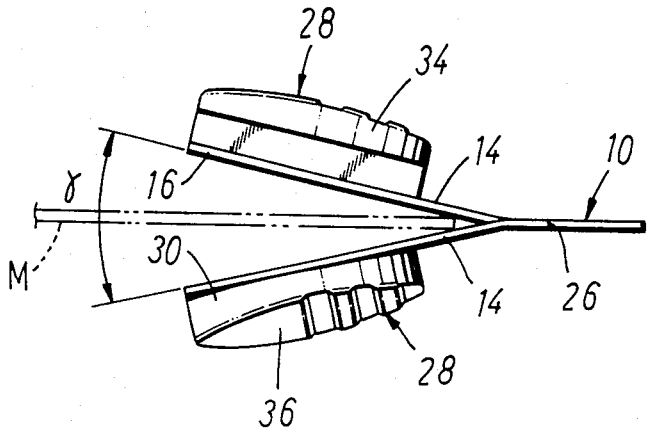
FIGS. 5 and 6 are side and front views of the scissors.

The numeral 26 denotes a pair of symmetrical, halves-bending lines formed on the planar surface of the metal sheet 10 in a carved stamp fashion at an obtuse angle $\beta$ with said parting line 12, as shown in a plan view in FIG. 8, said bending lines being located in the vicinity of the boundary stepped region between the parting line 12 and the bending guide hole 18. The half portions 14 of the metal sheet 10 are bent along the bending lines 26 in vertically opposite directions, as shown in FIGS. 5 and 6, whereby the pair of cutting edges 16 are normally maintained in horizontally, V-shaped opened state. The angle of intersection between the thus opened half portions 14 is indicated by the character $\gamma$.

Thus, the scissors of the present invention can, as such, be smoothly engaged with the object M and shear the object M by closing the half portions 14 against the spring force of the metal sheet 10 to cause the pair of cutting edges 16 to rub each other. In this case, since the half portions 14 of the metal sheet 10 are bent in opposite directions along the bending lines 26 crossing the parting line 12 at the obtuse angle $\beta$, as described above, the cutting edges 16 are urged in a frictional force receiving direction to strike each other both before and after the instantaneous rubbing action of the cutting edges 16 in shearing the object M by said action, with the result that the cutting edges 16 are not laterally separated from each other to escape from the object M and hence they can shear the object M more positively; thus, insufficient rubbing of the cutting edges 16 due to years of use can be effectively prevented.

Figure 9:
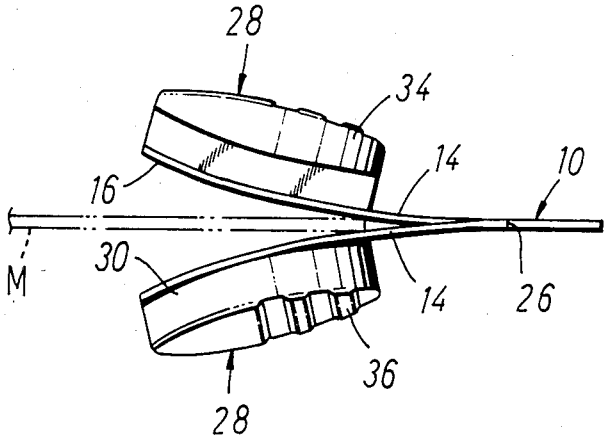
FIG. 9 is a side view showing a modification corresponding to FIG. 5.

In bending the half portions 14 of the metal sheet 10 into a V-shaped opened state, they may be bent simply in their planar state, as shown in FIG. 5, but more preferably the half portions 14 may be bent so that they are convexly curved and opposed to each other, as shown in FIG. 9. That is, the half portions 14 may be curved so that the inner sheet surfaces of the half portions 14 which directly contact the object M project toward each other. This arrangement makes it possible to cut the object M more stably and positively while effectively pressing and holding the object M quickly by the aforesaid convexly curved sheet surface of the half portions 14 in the course of shearing the object by the rubbing action of the cutting edges, without causing the cutting edges 16 to vertically retract from the object M.

The numeral 28 denotes a pair of operating levers attached to the half portions 14 for closing the latter. As can be seen from FIG. 6, the operating levers are each made in one piece of synthetic resin, and their cross-sections are substantially L-shaped, symmetrical and opposed to each other. The operating levers 28 will now be described in more detail with reference to FIGS. 11 and 12. The numeral 30 denotes attaching portions to be closely contacted with the planar surfaces of the half portions 14 along the cut edges of the half portions 14 serving as the cutting edges 16. A plurality of projections 32 integrally projecting from said operating levers are inserted into the associated attaching holes 22 and 24 of the metal sheet 10 from outside and are fixed therein as by crimping the front ends of the projections to the half portions 14 or injecting an adhesive agent. The numeral 34 denotes wing portions each extending like horizontal eaves from one half portion 14 to which the attaching portion 30 is attached, to overlie the planar surface of the other half portion 14, each wing portion rising a given distance H from the planar surface of the half portion 14 to which it is attached, so as to provide room for the other half portion 14 to pass after the rubbing of the cutting edges 16.

Figure 7:
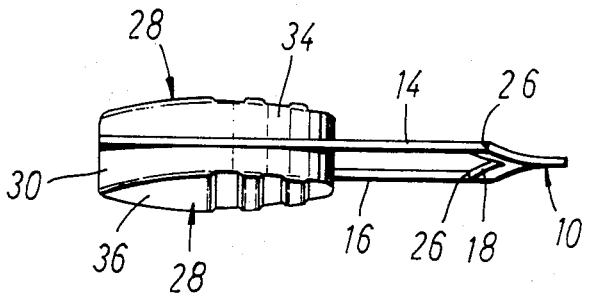
FIGS. 7 and 8 are side and plan views showing the closed state of the scissors.
Figure 10:
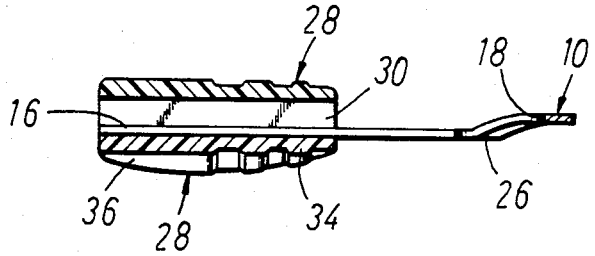
FIG. 10 is a sectional view taken along the line 10—10 of FIG. 8.

Thus, when the half portions 14 are closed as shown in FIGS. 7, 10 and 11 against the spring force of the metal sheet 10, the pair of operating levers 28 mesh with each other in male and female relation after vertically passing by each other beyond the planar state established at the instant the cutting edges 16 of the half portions 14 rub each other, until the half portions strike the wing portions 34 of the opposed operating levers 28.

Therefore, the distance they pass is substantially equal to the rising distance H. The rubbing portions of the cutting edges 16 are vertically covered with the operating levers 28, so that there is no possibility of hurting the user. Thus, lightness of operation and safety in use are ensured. It is desirable that the operating levers 28 of synthetic resin be colored for aesthetic purposes and that the outer surfaces of the operating levers 28 to which user's fingers are applied be made uneven to prevent slippage of fingers.

As is clear from FIG. 8, the operating levers 28 are circular in plan view so that they can be easily held by fingers, but rectangular operating levers may be used, attached to the scissors in such a manner as to vertically cover the rubbing portions of the cutting edges. Further, the operating levers 28 may be integral with the metal sheet 10 and formed by being continuously bent out of the metal sheet 10 to be opposed to each other as described above.

At any rate, the outer surfaces of the operating levers 28 to which user's fingers are applied (that is, the upper surface of the upper lever and the lower surface of the lower level) are inclined so that surface 36 crosses the planar surface of the metal sheet 10 at an acute angle $\theta$ when the scissors are viewed from their front side in which the object M is to be inserted or from their rear, and preferably the inclined surfaces 36 are substantially parallel to each other between the levers 28. With this arrangement, when the user applies his fingers to the inclined surfaces 36 of the operating levers 28 to close the half portions 14, frictional forces in the directions of arrows F in FIGS. 6 and 12 are applied to the cutting edges 16, causing the latter to strike each other. Thus, in shearing the object M, the cutting edges 16 will not separate from each other to laterally escape from the object M, so that the effect of cutting the object M can be further improved and changes in the thickness of the object M can be accommodated.

As is clear from the aforesaid arrangement, in using the scissors of the present invention, the user applies the normally opened half portions 14 of the metal sheet 10 to the object M such as paper, cloth, thread of synthetic resin film, as shown in FIGS. 5 and 12, and then closes the half portions 14, as shown in FIGS. 7 and 11, by pressing the operating levers 28 with fingers against the spring force of the metal sheet 10.

As a result, the cutting edges 14 formed by the cut edges of the half portions 14 rub each other, thus shearing the object M. Thus, the scissors may be advanced through the object M while repeating such operation bit by bit. Further, while holding the object M between the half portions 14 which are now somewhat closed, the scissors may be pulled back relative to the object M, causing the cutting edges 16 to act as cutter knives to cut the object M.

Figure 13:
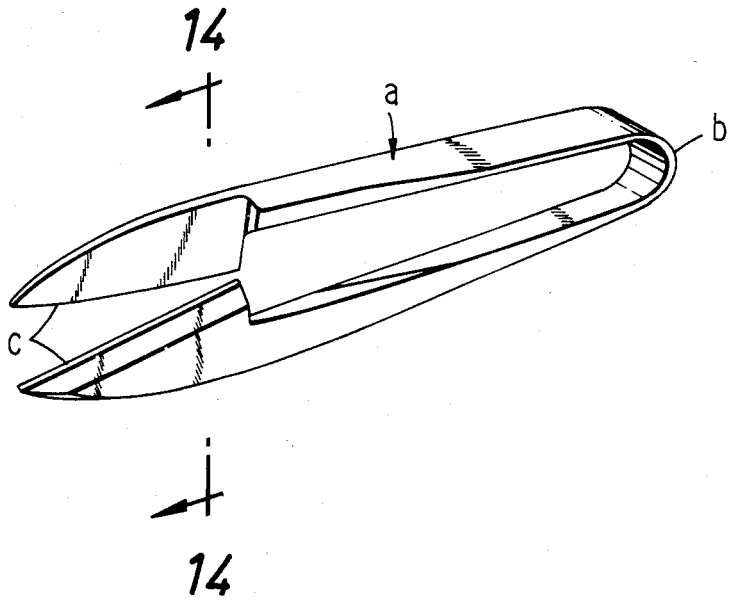
FIG.13 (Prior Art)
FIG. 13 is a perspective view of a known conventional handy scissors shown for comparison with the present invention.
Figure 14:
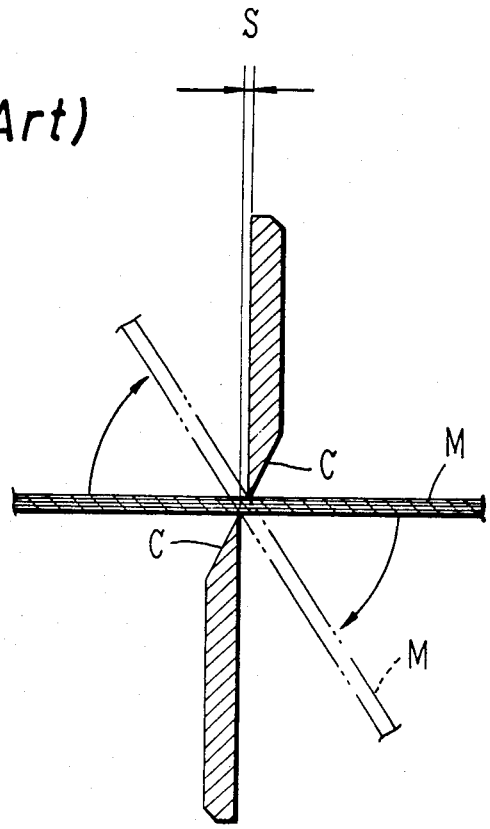
FIG.14 (Prior Art)
FIG. 14 is an enlarged sectional view taken along the line 14—14 of FIG. 13.
Figure 15:
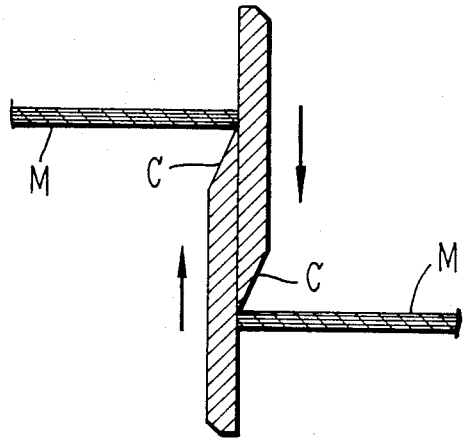
FIG.15 (Prior Art)
FIG. 15 is an enlarged sectional view showing the closed state corresponding to FIG. 14.

The last-mentioned way of use is impossible with the known handy scissors described at the outset. That is, in the known scissors, as shown in FIGS. 13–15, the thickness of the steel member a is not uniform throughout and the bent proximal end portion b formed in horizontal U-shape is thinned and flattened like a horizontal sheet, while the opposed front ends portions are substantially vertical flat sheets, said portions being specially machined to serve as a pair of cutting edges c comprising sharp edges. As a result, the cutting edges c in the front end portions lack stability in holding the object M, particularly a sheet-like object M.

Further, since the spring member a is simply bent to bring the cutting edges c into opposed relation to each other so that they rub each other, the cutting edges c tend to separate laterally from each other, as shown in FIG. 14, during the operation of shearing the object M, thus forming a clearance S in which the object M is held and turns to assume an incorrect attitude, so that the object can hardly be cut. This phenomenon becomes more noticeable when coupled with the aging of the cutting edges c and a variation in the thickness of the object M, thus making smooth operation impossible. The scissors are very dangerous to use since the cutting edges c are exposed. Furthermore, since it is necessary to specially machine the cutting edges c, it must be said that though the scissors are relatively simple in form, it is still impossible to expect the effect of mass-production to the greatest extent.

According to the aforesaid arrangement of the present invention, such problems can all be solved, and the intended objects can be effectively achieved. It is understood that various changes and modifications may be made in the embodiment of the invention disclosed without departing from the spirit of the invention.

What is claimed is:

1. A pair of handy scissors comprising a plate body having an eliptical hole, a parting line projected from a margin of said hole to a margin of said plate body, said parting line being cut at an angle other than a perpendicular angle to said plate body so as to form an acute and an obtuse angle on each side of the plate body, two blade portions defined by said parting line and the margins of said plate body, said blade portions each being bent in an arc in opposite directions away from the plane of the plate from a line projecting from said eliptical hole to form a crease at an oblique angle to said parting line, said bends being formed such that the acute angles formed between the surface of each blade half and the parting line are disposed toward the plane of the plate body and two operating levers attached to said blade halves on the inner surfaces of the arcuate blade halves, said levers having surfaces whereby pressure may be applied at an angle to said blade portion surfaces and being relieved on the side facing the opposing blade portion so as to receive said opposite blade portion when the blades are forced to pass each other.

2. Handy scissors according to claim 1, wherein the parting line is cut in a regular and repeating pattern.

3. Handy scissors according to claim 2, wherein the repeating pattern is a sine curve.

4. Handy scissors according to claim 2, wherein the repeating pattern is a zig-zag.

5. Handy scissors according to claim 1, wherein the surface of the attached levers to which force is applied are angled such that the angle between the surface of the blade halves and the surface of the lever to which force is applied is an acute angle at the margin of the blade halves opposite the parting line.

* * * * *